US007717717B1

(12) United States Patent
Lai

(10) Patent No.: US 7,717,717 B1
(45) Date of Patent: May 18, 2010

(54) USER-FRIENDLY USB CONNECTOR

(76) Inventor: Joseph Lai, 950 Sampson Way #108, San Pedro, CA (US) 90731

( * ) Notice: Subject to any disclaimer, the term of this patent is extended or adjusted under 35 U.S.C. 154(b) by 0 days.

(21) Appl. No.: 12/492,763

(22) Filed: Jun. 26, 2009

(51) Int. Cl.
*H01R 12/00* (2006.01)

(52) U.S. Cl. ..... 439/66

(58) Field of Classification Search ..... 439/66, 439/62, 660, 466; 455/575.1; 710/62
See application file for complete search history.

(56) References Cited

U.S. PATENT DOCUMENTS

| | | | | |
|---|---|---|---|---|
| 6,626,706 | B2 | 9/2003 | Siddiqui et al. | |
| 6,893,267 | B1 | 5/2005 | Yueh | |
| 6,948,983 | B1 | 9/2005 | Peng | |
| 6,981,887 | B1 | 1/2006 | Mese et al. | |
| 6,991,483 | B1 * | 1/2006 | Milan et al. | 439/171 |
| 7,004,794 | B2 | 2/2006 | Wang et al. | |
| 7,052,287 | B1 | 5/2006 | Ni et al. | |
| 7,090,541 | B1 | 8/2006 | Ho | |
| 7,331,796 | B2 * | 2/2008 | Hougham et al. | 439/66 |
| 7,381,060 | B2 * | 6/2008 | Ju | 439/66 |
| 7,467,951 | B2 * | 12/2008 | Hougham et al. | 439/66 |
| 7,507,119 | B2 * | 3/2009 | Ni et al. | 439/607.31 |
| 7,537,471 | B2 | 5/2009 | Teicher | |
| 7,645,147 | B2 * | 1/2010 | Dittmann | 439/82 |
| 2009/0111320 | A1 * | 4/2009 | Johansson et al. | 439/466 |
| 2009/0111533 | A1 * | 4/2009 | Johansson et al. | 455/575.1 |

* cited by examiner

*Primary Examiner*—Chandrika Prasad

(57) ABSTRACT

A new user-friendly USB (Universal Serial Bus) male connector is physically and functionally compatible to the existing and future USB female connectors. Unlike the conventional keyed, polarized and position dependent USB male connector. The new user-friendly USB male connector provides spare connections, eliminates potential connector damage and allows normal and opposite insertions to the USB female connectors.

17 Claims, 7 Drawing Sheets

USER-FRIENDLY USB CONNECTOR

FIELD OF THE INVENTION

This present invention is related to improve existing and future USB (Universal Serial Bus) connectors and provides better user-friendly connections between a host computer and its peripherals.

BACKGROUND OF THE INVENTION

Why is this invention necessary?

The Problems:

USB devices are extremely popular as today's standard connectors for host computers to connect and communicate to its peripheral devices. Typical USB devices, such as, computer keyboards, mice, printers, cameras, scanners, modems, battery chargers, PDAs, cellular phones, external hard disks (flash drives) and so forth. However, the trouble is, the peripheral part of USB male connector is "keyed" and not symmetrical to the USB female connector, so it has to be in the correct orientation (to match the USB female counter part) in order to plug into the USB female connector of the host computer. The USB male connector on the peripheral is a narrow rectangle. It looks symmetrical outside but is "keyed" inside. The USB female receptacle connector is also a rectangular and looks symmetrical outside too. Some USB male connector does have markings of its orientation. It takes education to know which side should be up or down (or left and right). After all, some computers have the female connector mounted upside down, and some computers have their USB connector mounted vertically. It is difficult, confusing and frustrating for computer users to know the right way to plug their devices (or cables) into the host computers, especially since the USB female connector is often hard to see and reach or on the back side of the host computers.

When they cannot tell which orientation is correct, some USB users use too much force trying to insert the USB male connector and end up damaging both sides of the USB connectors.

The other problem is that these conventional USB male connectors have only one set of connection pins, unlike host computers, have more, if these connectors are damaged, this USB based product becomes useless.

The Solution:

The present invention is directed to provide solutions to the poorly designed conventional USB connectors with a new user-friendly USB male connector which is not polarized, not keyed. It can plug into the USB female connector of the host computer either way.

Further more, somehow, if some of the connection pins are damaged, there is a $2^{nd}$ set of connector pins to provide the spare connection.

SUMMARY OF THE INVENTION

The conventional type "A" USB male connector is designed to plug into the type "A" USB female connector in one orientation, they have to match. The current USB male connector has a rectangular metal shell. Half of the USB male connector is filled with plastic (or non-conductive equivalent material) and attaches conductive contact pins, half of the USB female connector (on the computers or cables) is also filled with plastic and attached with conductive contact pins.

This present invention converting the plastic part of the conventional USB male connector, making the plastic part thinner, placing it in the middle of the metal shell, keeping original conductive contact pins on top and providing additional conductive contact pins on bottom side of the thin plastic. This design allows the USB female connector contact pins to make connection to pins on either top or bottom side of the modified USB male connector.

Compare present User-Friendly USB Male Connector vs. Conventional USB Male Connector:

| | User-friendly type "A" USB male connector (the invention) | Conventional type "A" USB male connector (prior art) |
|---|---|---|
| Fast to plug in? | Yes | No |
| Works in opposite position? | Yes | No |
| Spare or backup connections? | Yes | No |
| Preventing/protecting damage to USB connector? | Yes (Plug in either way . . . so it won't damage the connectors) | No (Wrong way and brute force insertions will damage both USB connectors) |
| How about cost? | Cost less as no plastic wasted to serve as "key" | Cost more |
| Overall performance? | Perfect | Need improve |

DETAILED DESCRIPTION

The present invention converts and improves the conventional type "A" USB male connectors. These connectors are normally located on the peripheral part of the computer systems. The host computers always use type "A" USB female connectors to connect to outside world.

Since the peripheral devices are more demanding and produced, it is logical to modify and improve the conventional USB male connectors on the peripherals to provide these new features.

Figure 1A:
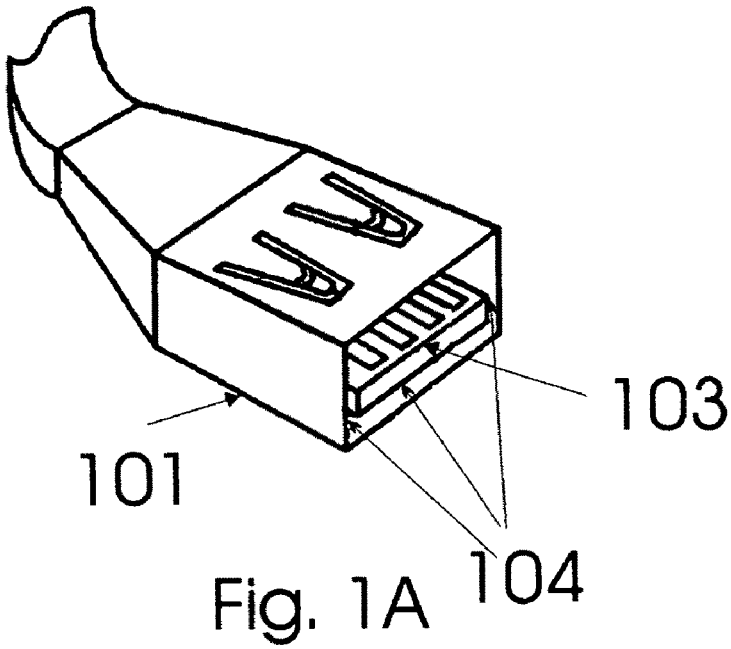
FIG. 1. USB female connector for host computers
Figure 1B:
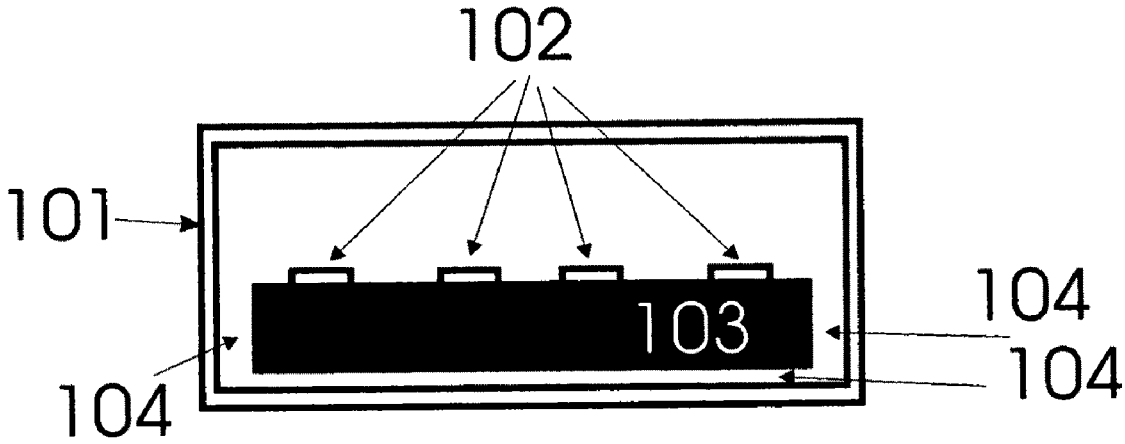

FIG. 1 shows the conventional type "A" USB female connector located mostly on the host computer. As we can see, the outside rectangular is a metal housing/shell (101). Inside of the metal housing/shell, there is a rectangular plastic carrier (103) that holds and supports 4 conductive contact pins (102).

Notice the rectangular plastic carrier (103) is like a "tongue" sticking out afloat from the rear holder. There are gaps/spaces (104) from the metal housing/shell (101) to the rectangular plastic carrier (103). These gaps/spaces (104) allow conventional type "A" USB male connectors to plug into the inner side of the type "A" USB female connector.

Figure 2:
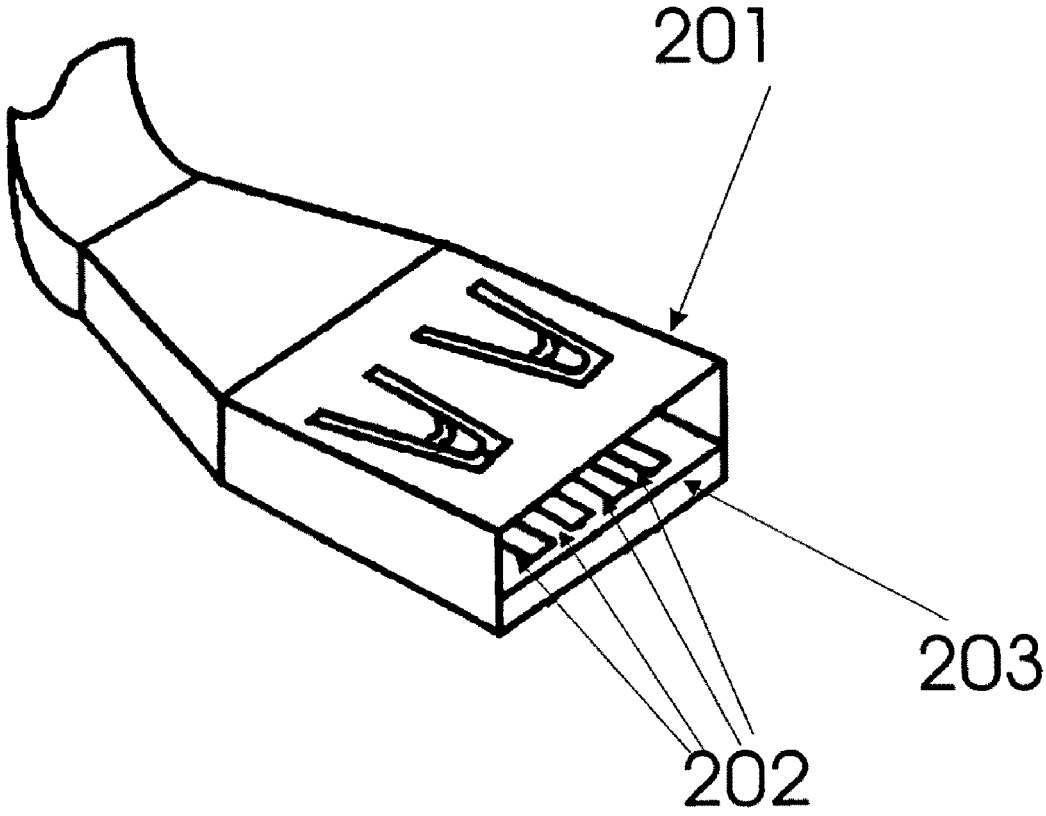
Fig. 2 (PRIOR ART)
FIG. 2. (Prior Art) Conventional USB male connector for peripheral devices

For the conventional type "A" USB male connectors, FIG. 2 shows a rectangular metal housing/shell (201) which is slightly smaller than the previously mentioned type "A" USB female connector housing/shell so the type "A" USB male connector housing/shell can fit and plug into the inside of type "A" USB female metal housing/shell (101). The inside of the conventional type "A" USB male FIG. 2, is filled half way with plastic carrier (203) and 4 conductive contact pins (202). Since the plastic part (203) of the type "A" USB male connector is half filled inside the metal housing/shell (201), it serves as a directional "key", therefore, the type "A" USB male connector can only plug into the type "A" USB female according to the "key" position. The conventional type "A" USB male connector can "not" plug into the conventional type "A" USB female connector in the opposite orientation.

Figure 3:
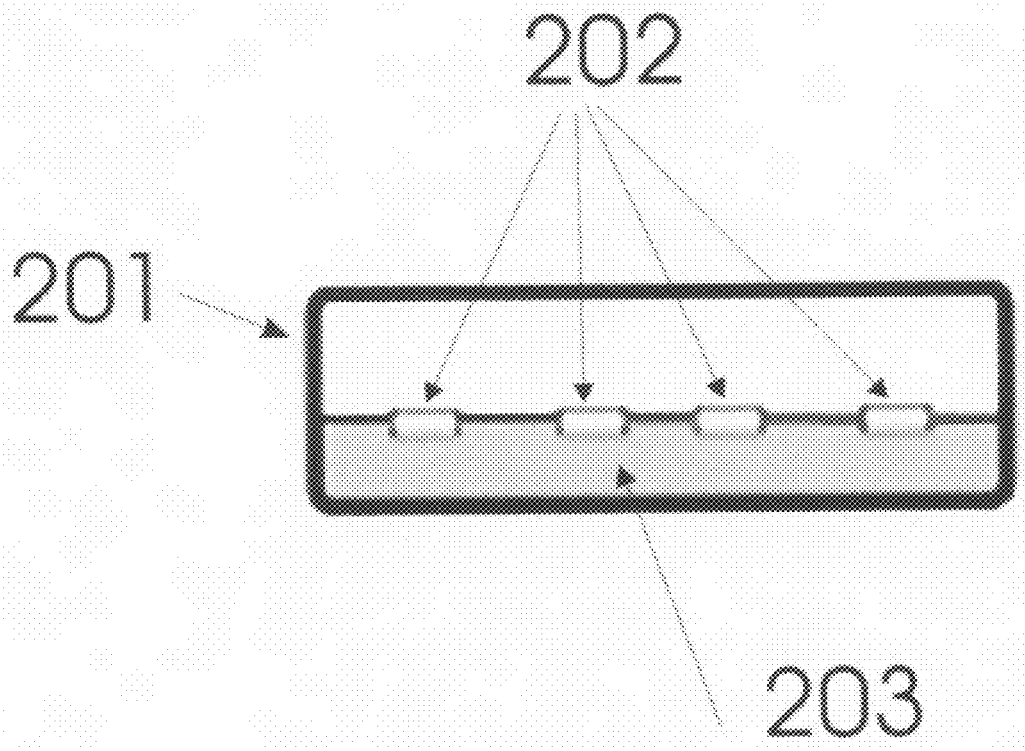
Fig. 3 (PRIOR ART)
FIG. 3. (Prior Art) Enlarged view of conventional USB male connector

FIG. 3 shows the enlarged view of conventional type "A" USB male connectors. The plastic part (203) is filled half way inside, to serve as directional "key" and there is no gaps between the plastic part (203) and the rectangular metal housing/shell (201) of the type "A" USB male connector.

Figure 4:
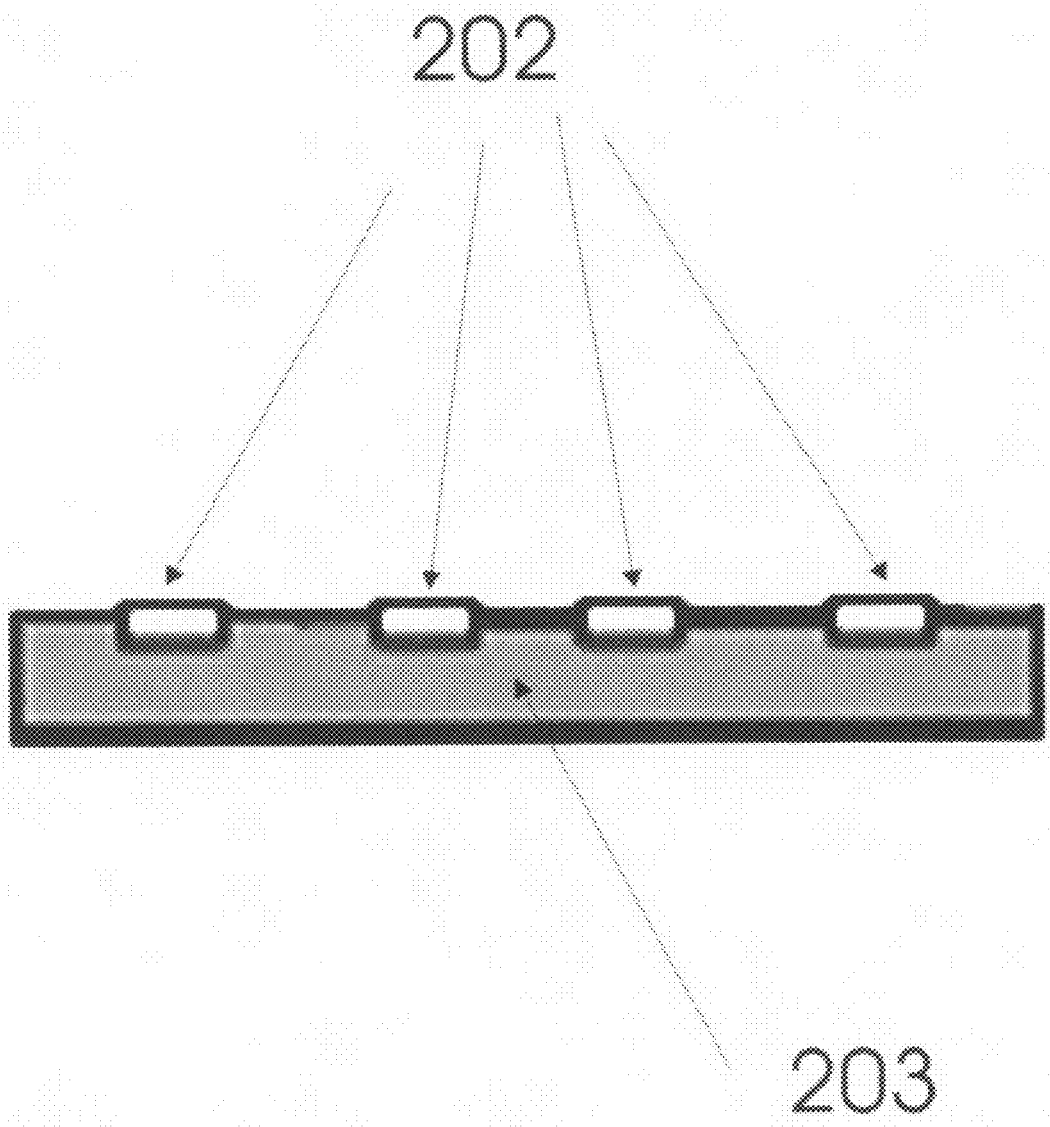
Fig. 4 (PRIOR ART)
FIG. 4. (Prior Art) Conventional USB male connector without metal housing

FIG. 4 shows the conventional type "A" USB male connector rectangular plastic piece without metal housing. As we can see clearly, the trouble is, this plastic (202) is half the size of the opening of the metal housing/shell (201), making the conventional type "A" USB male connector only plug into the female counter part the "matching" way.

Figure 5:
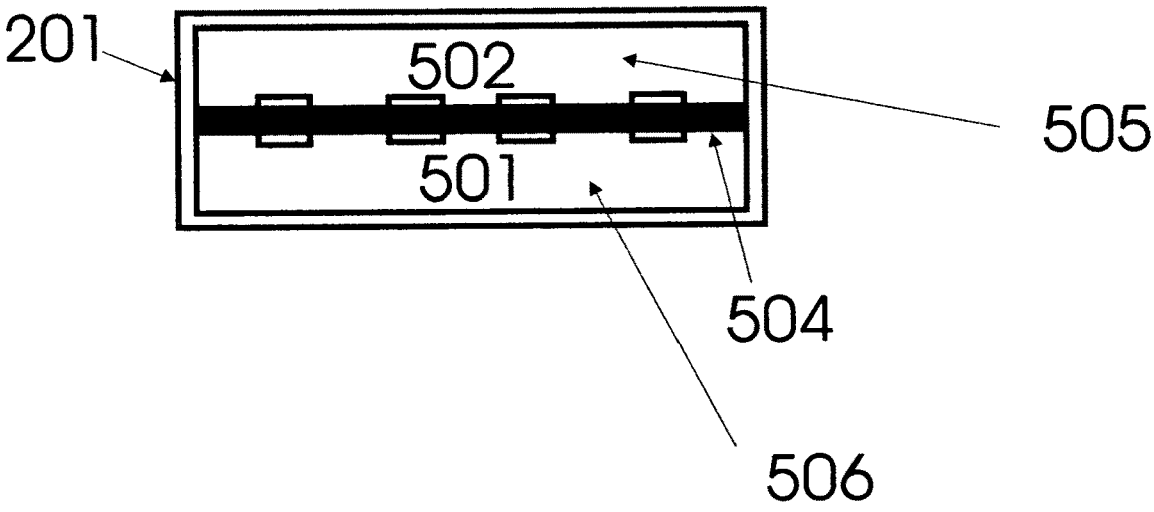
FIG. 5. New design of USB male connector

The present invention of user-friendly USB male connector is reducing the size of the rectangular plastic (203) inside the conventional type "A" USB male connector, make it much thinner (0.024") (504). The thin plastic (504) is placed and attached at the center of the conventional type "A" USB male connector housing/shell (201). As we can see FIG. 5, the thin plastic (504) does not fill half the space as the conventional type "A" USB male connector does. The thinner plastic (504) is placed at the center of the conventional type "A" USB male connector housing/shell (201) and provides symmetrical and equal spacing from top to the thin plastic (505) and bottom to the thin plastic (506).

Now, there is no "key" effect for the newly modified type "A" USB male connector. This newly modified type "A" USB male connector can plug into the conventional type "A" USB female connector either way. When this newly modified type "A" USB male connector is plugged into the type "A" USB female connector regularly, the bottom part (501) of the conductive contact pins on the thin plastic (504) is in contact with conductive contact pins (102) and rectangular plastic carrier (103) of the type "A" USB female connector. When we "reverse" the insertion of the newly modified type "A" USB male connector and plug it into the conventional type "A" USB female connector, the top part of the conductive contact pins (502) on the thin plastic (504) will contact with the conductive contact pins (102) and rectangular plastic carrier (103) of the conventional type "A" USB female connector.

Figure 6:
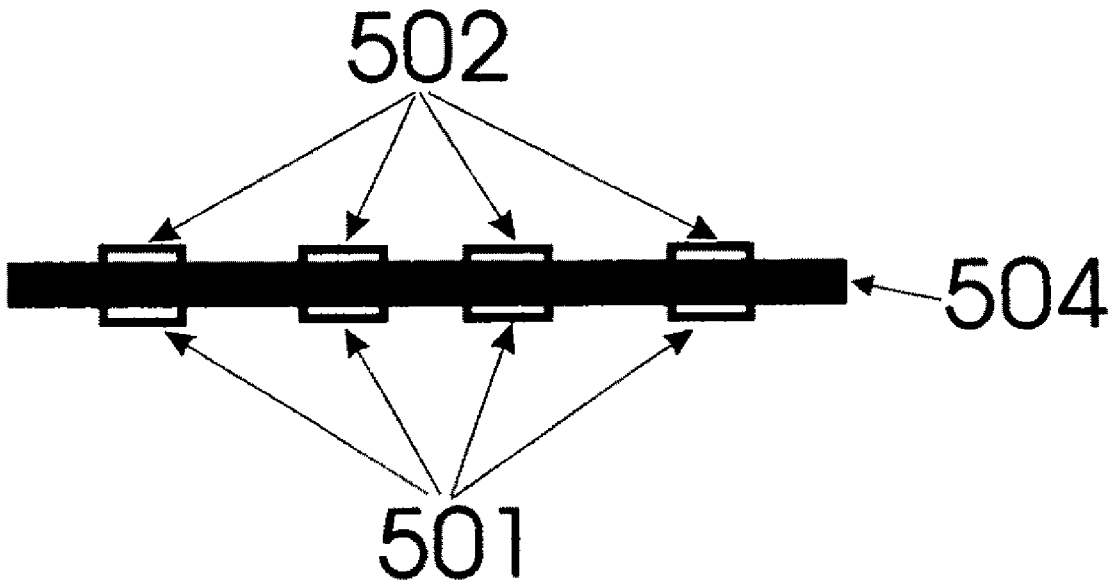
FIG. 6. New design of USB male connector without housing

FIG. 6 shows the "thin" rectangular piece (504) of the connector without housing. There are conductive contact pins (501) (502) on opposite sides of the piece.

Figure 7A:
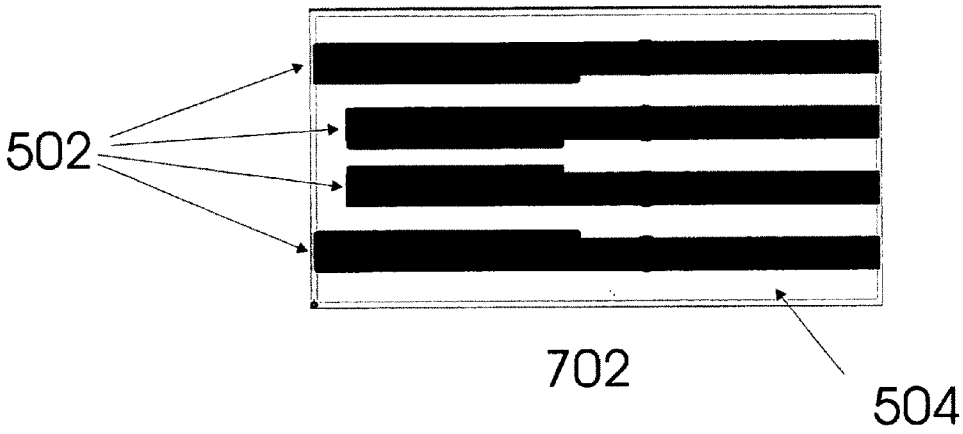
FIG. 7. Plastic part of the new USB male connector with 2 sets of conductive contact pins
Figure 7B:
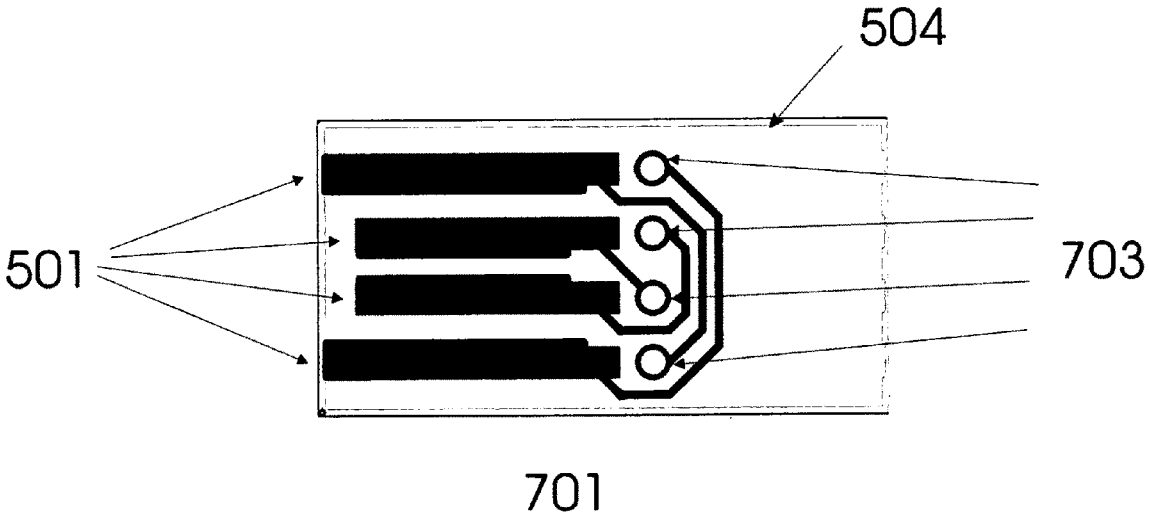

FIG. 7 shows the thin plastic piece (504) with the 4 position conductive contact pins (701) (702) on the modified thin plastic piece. Normal, regular insertion of the user-friendly USB male connection uses (701) conductive contact pins. The other 4 position conductive contact pins (702) is for opposite insertions and conductive contact pins have to be re-arranged and in reverse order for connection to the peripheral devices.

The recommended way of implementation is to use a thin (0.024 inch), strong, low-cost double layered fiber glass (FR4) PC (Printed Circuit) board, etches the copper traces as conductive contact pins, plates it with gold on both side of the PC board, drills through holes (703), and routes the traces to mirror and reverse the arrangement of 4 wires of the user-friendly type "A" USB power lines and signals.

The newly modified user-friendly type "A" USB male connector is 100% physically and functionally compatible to the existing and future USB female type "A" connectors. It is a truly user-friendly operation with the spare set of conductive contact pins for users to quickly and easily plug into their peripheral devices and eliminating the possibilities of damaging both male and female USB connectors.

This present invention will also be compatible with future and newly published USB 3.0 specifications. As same design concepts of this invention with current USB 1.0 and 2.0 specifications, futuristic USB 3.0 specifications provides additional 5 more smaller conductive contact pins (on the same side) behind original 4 conductive contact pins. To provide the same user-friendly results to allow user to plug the type "A" USB male connector either way, simply add additional set of conductive contact pins on both side (501) (502) of the thin plastic (504) (701) and (702) to make it will compatible with futuristic USB 3.0 specifications.

I claim:

1. A user-friendly male connector comprising:

a center connector piece with a plurality of conductive contacts on a first side of said center connector piece and on a second side of said center connector piece, wherein each of said plurality of conductive contacts on said first side is electrically connected to a corresponding conductive contact on said second side; and a housing within which said center connector piece resides wherein said user-friendly male connector is a type "a" Universal Serial Bus (USB) male connector.

2. The user-friendly male connector of claim 1, wherein each of said plurality of conductive contacts on said first side is electrically shorted to a corresponding conductive contact on said second side.

3. The user-friendly male connector of claim 1, wherein said center connector piece is flat, thin and rigid.

4. The user-friendly male connector of claim 1, wherein said center connector piece is made of non-conductive material, wood, ceramic, hardened plastic, epoxy, and/or fiberglass.

5. The user-friendly male connector of claim 1, comprising a holder that holds said center connector piece within said housing.

6. The user-friendly male connector of claim 5, wherein said holder comprises two spacers for holding said center connector piece within said housing.

7. The user-friendly male connector of claim 5, wherein said holder is made of non-conductive material, wood, ceramic, hardened plastic, epoxy, and/or fiberglass.

8. A method for making a user-friendly male connector comprising a connector housing with a center connector piece within said connector housing, wherein said center connector piece comprises a first side and a second side, and each of a plurality of conductive contacts on said first side is electrically connected to a corresponding conductive contact on said second side wherein said user-friendly male connector is a type "a" Universal Serial Bus (USB) male connector.

9. The method of claim 8, wherein each of said plurality of conductive contacts on said first side is electrically shorted to said corresponding conductive contact on said second side.

10. The method of claim 8, wherein said center connector piece is flat, thin and rigid.

11. The method of claim 8, wherein said center connector piece is made of non-conductive material, wood, ceramic, hardened plastic, epoxy, and/or fiberglass.

12. The method of claim 8, comprising a holder that holds said center connector piece within said housing.

13. The method of claim 8, wherein said holder is made of non-conductive material, wood, ceramic, hardened plastic, epoxy, and/or fiberglass.

14. The method of claim 12, wherein said holder comprises two spacers for holding said center connector piece within said housing.

15. A user-friendly male connector comprising:

a flat, thin, rigid center connector piece, with a plurality of conductive contacts on a first side of said center connector piece and on a second side of said center connector piece, wherein each of said plurality of conductive contacts on said first side is directly electrically connected to a corresponding conductive contact on said second side; and a housing within which said center connector piece resides wherein said user-friendly male connector is a type "a" Universal Serial Bus (USB) male connector.

16. The user-friendly male connector of claim 15, wherein said center connector piece is made of non-conductive material, wood, ceramic, hardened plastic, epoxy, and/or fiberglass.

17. The user-friendly male connector of claim 15, comprising a holder holds said center connector piece within said housing.

* * * * *